US006338410B1

(12) United States Patent
Wasmund

(10) Patent No.: US 6,338,410 B1
(45) Date of Patent: Jan. 15, 2002

(54) TRANSPARENT FRAME CARTON ENCLOSURE

(75) Inventor: Neil A. Wasmund, Louisville, KY (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/621,526

(22) Filed: Jul. 21, 2000

(51) Int. Cl.[7] ..... B65D 65/00
(52) U.S. Cl. ..... 206/778; 206/526; 206/497
(58) Field of Search ..... 206/497, 526, 206/778

(56) References Cited

U.S. PATENT DOCUMENTS

| | | | | |
|---|---|---|---|---|
| 2,739,089 A | | 3/1956 | Hageltorn | |
| 3,650,395 A | * | 3/1972 | Hobbs | 206/497 |
| 3,759,373 A | | 9/1973 | Werth et al. | |
| 3,807,117 A | | 4/1974 | Abrams | |
| 3,809,227 A | | 5/1974 | Begemann | |
| 3,902,992 A | | 9/1975 | Schuster | |
| 4,201,298 A | * | 5/1980 | Larson et al. | 206/387 |
| 4,253,570 A | * | 3/1981 | O'Connor | 206/597 |
| 4,576,675 A | | 3/1986 | Brux | |
| 4,589,946 A | | 5/1986 | Borrow | |
| 4,628,666 A | | 12/1986 | Lems | |
| 4,685,993 A | | 8/1987 | Flaherty et al. | |
| 4,895,255 A | * | 1/1990 | Fisher | 206/497 |
| 4,930,293 A | | 6/1990 | Hanscom | |
| 4,940,137 A | | 7/1990 | Straub | |
| 5,016,761 A | * | 5/1991 | Stoddard et al. | 206/497 |
| 5,214,901 A | | 6/1993 | Milliner | |
| 5,314,557 A | | 5/1994 | Schwartz et al. | |
| 5,339,957 A | | 8/1994 | Carstens | |
| 5,551,212 A | | 9/1996 | Odenthal | |
| 5,640,830 A | | 6/1997 | Jabalee et al. | |
| 5,735,104 A | | 4/1998 | Odenthal | |
| 5,747,131 A | | 5/1998 | Kreckel | |
| 5,775,486 A | | 7/1998 | Edqvist | |
| 5,797,242 A | | 8/1998 | Sauer | |

* cited by examiner

*Primary Examiner*—David T. Fidei
(74) *Attorney, Agent, or Firm*—John F. Salazar; Middleton Reutlinger

(57) ABSTRACT

A transparent frame carton enclosure for retaining a carton of cigarette packages in side-by-side relationship is disclosed. The transparent frame carton enclosure allows the packages to be clearly evident and visible. The transparent frame carton enclosure has an upper frame portion which extends around the upper periphery of the plurality of packages and a lower frame portion which also extends along the lower periphery of the plurality of packages. The transparent frame carton enclosure also has an interconnection mechanism so that a number of the combined packages may be releasably interconnected with each other for stacking and interlocking. Further, the transparent frame carton enclosure may not extend along the top surface or bottom surface of the combined package unit so that they may readily be accessible for placement of additional material thereon. The carton enclosure also leaves the front surface of each of the plurality of packages unobstructed for application of additional printed material or advertisements thereon.

12 Claims, 3 Drawing Sheets

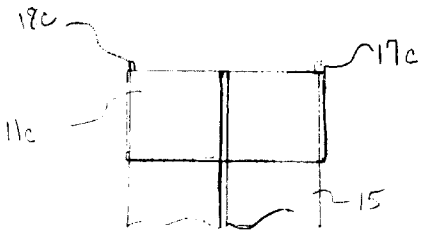
Fig. 6
Fig. 7
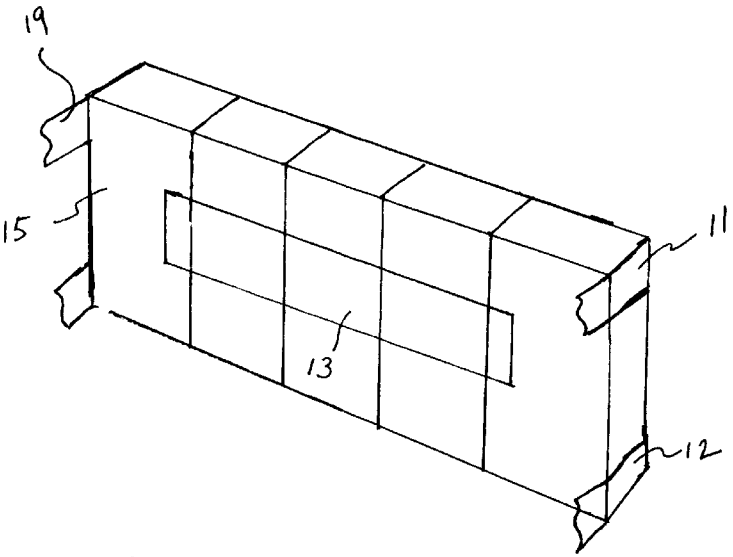
Fig 6a
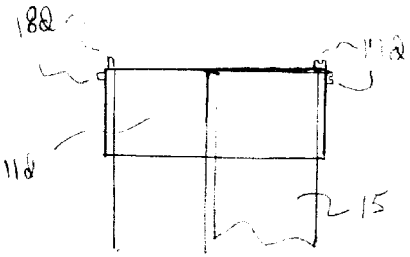

TRANSPARENT FRAME CARTON ENCLOSURE

BACKGROUND OF THE INVENTION

1. Field of the Invention

The present invention relates to transparent enclosures, and, more particularly, to acrylic frame carton enclosures that are used in the packaging industry which can bind packages together, and which also can themselves bind multiple carton enclosures together.

2. Description of Prior Art

Packaging small containers together in large groupings is accomplished in the packaging field typically by placing small containers into a box or other type of carton. When viewing of the small containers is desired, plastic shrink wrap or other material placed over the entire package is utilized. If a user desires to group small containers together and leave areas open for affixing coupons and other promotional material combined, the package design has significantly more limitations. Another known method of attaching packages together is use of adhesive strips or like material. U.S. Pat. No. 5,214,901 disclosed the utilization of an adhesive label to be applied to the bottom of packages in order for binding of two packages together into a single unit. However, the use of adhesives in such a manner limits the availability of combining large number of packages together and doesn't allow easy access to the bottom surface covered.

An alternative embodiment is displayed in U.S. Pat. No. 4,685,993 wherein a long band is applied to both the side surface of two packages so that they may be affixed in side-by-side relationship. However, ready access to the various surfaces of the packages is not available in such an embodiment. There are a number of different apparatuses known in the prior art for the application of binding packages together. None of these prior art references, however, teach the application of a transparent frame carton enclosure wherein the various panels of the package or container are available for access of the application of additional advertising material or other printed matter. Additionally, none of these prior art references allow the binding mechanism to be releasably attached to a neighboring binding mechanism so that the combined packages may be affixed together or combined in formation.

SUMMARY OF THE INVENTION

The present invention is for a transparent frame carton enclosure which binds a plurality of small packages together into a single unit. The transparent carton frame enclosure of the present invention allows the packages to be bound together in such a manner that the various surfaces of the packages are available for adding printed material, advertising information or potentially tax stamps, as is commonly the case for cigarette products.

It is therefore an object of the present invention to provide a transparent frame carton enclosure which allows multiple packages to be bound together in carton-like form.

Another object of the present invention is to provide a transparent frame carton enclosure wherein the upper surface of the packages are readily available for attachment of tax stamp or other like material.

An even further object of the present invention is to provide a transparent frame carton enclosure wherein an upper frame enclosure and a lower frame enclosure is utilized and adhered to both the upper portion of the combined packages and the lower portion of combined packages.

An additional object of the present invention is to provide a transparent frame carton enclosure wherein each of the frames of the carton enclosure have a releasably engageable attachment mechanism for binding together adjacent combined package units in a secure manner. Thus, the combined package units which the transparent frame carton enclosure creates may be releasably attached to a neighboring combined package unit and each of the units thereby may be stacked to create a display or other secure formation.

Even more particularly, the present invention comprises a transparent frame carton enclosure which encloses a plurality of packages, preferably cigarette packages, and wherein the carton enclosure is comprised of an upper frame portion and a lower frame portion. The upper frame portion wraps circumferentially around the upper exterior sidewall portion of the combined package unit, namely for cigarette packages, combined package units resembling cigarette cartons. The combined package unit also incorporates a lower frame portion which circumferentially wraps the lower sidewall portion of the combined package unit. Both the upper frame portion and the lower frame portion of the transparent frame carton enclosure securely retain the plurality of packages of the combined package unit together in a form which is similar to the commonly known cardboard carton and which also allows ready access to both the front surface and top or bottom surface of each individual package contained within the combined package unit.

Even further, the present invention incorporates utilization of an upper frame portion and a lower frame portion wherein both the upper frame portion and lower frame portion includes use of a locking bead and locking groove so that adjacent package units may be releasably locked together in secure form. These and other objects are met by the transparent frame carton enclosure of the present invention.

BRIEF DESCRIPTION OF THE DRAWINGS

A better understanding of the present invention will be had upon reference to the following description in conjunction with the accompanying drawings, wherein:

FIG. 2 is a partial cut-away perspective view of the transparent frame carton enclosure shown in FIG. 1;

FIG. 6 is an end view an alternative embodiment of the transparent frame carton enclosure of the present invention; and, FIG. **6*a*** is an end view of an additional alternative embodiment of the transparent frame carton enclosure of the present invention.

DETAILED DESCRIPTION OF THE PREFERRED EMBODIMENT

Figure 1:
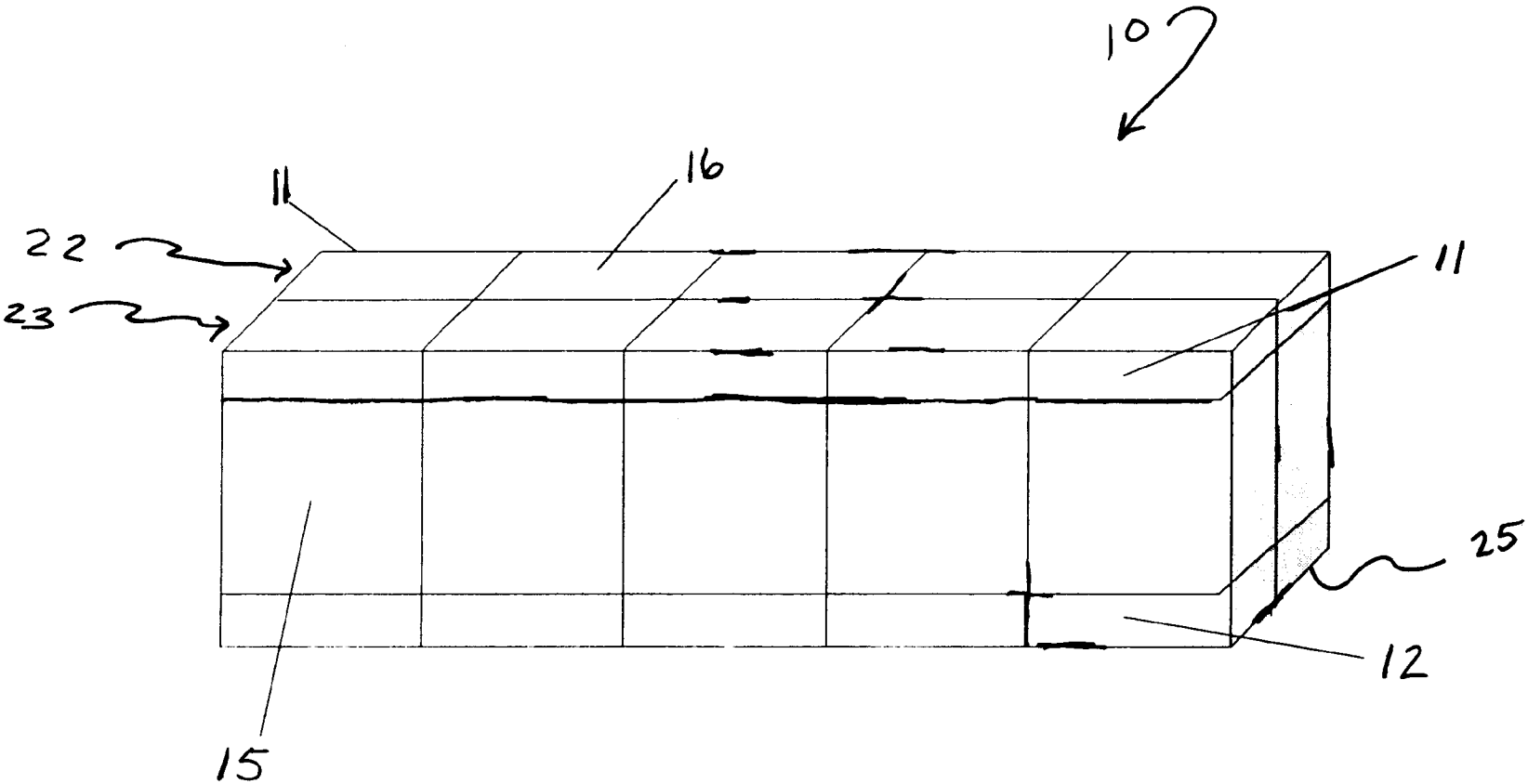
FIG. 1 is a perspective view of the combined package unit having the transparent frame carton enclosure of the present invention.

A combined package unit 10 which is created by utilization of the transparent frame carton enclosure of the present invention is shown in FIG. 1. The transparent frame carton enclosure of the present invention is comprised of the upper frame portion 11 and the lower frame portion 12 which is depicted in the figure. As shown therein, a plurality of packages 15 are combined together to form the combined package unit 10. Each of the individual packages 15, as shown in FIG. 1, are rectangular in shape, and in this example, are representative of cigarette packs or like packages. However, it is understood that many different package shapes and types may be utilized and thus the application of the transparent frame carton enclosure of the present invention to various type packages is considered to fall within the scope of the inventive concept.

The combined package unit 10 is comprised of a plurality of packages 15, here shown as a combined unit of ten separate cigarette packs. The combined package unit 10 is held together by a transparent upper frame portion 11 and a transparent lower frame portion 12. Both the upper frame portion 11 and lower frame portion 12 wrap around the periphery of the combined package unit 10 on either the upper portion of the sidewall of the combined package unit or along the lower portion of the sidewall of the combined package unit 10. As depicted in FIG. 1, the upper frame portion 11 and lower frame portion 12 retain the combined package unit 10 in a single unit and replace the commonly known cardboard cigarette cartons in which packages 15 are usually placed.

As depicted in FIG. 1, the packages are placed side to side, five packages forming one row with the second row of five packages in back-to-back relationship with the first row. Thus, the first row of packages 23 has each of the five packages comprising said first row faced outwardly so that the front face of each individual package 15 is visible. Likewise, second package row 22 is comprised of five individual package units which are each faced outward so that the back panel of each individual cigarette package is in back to back abutting relationship with an adjacent back panel of a cigarette package in the opposing row.

The upper frame portion 11 wraps around the periphery of the combined package unit 10 and contacts the sidewall surface of each individual package, the sidewall of the package being comprised of either the depending front face of the package or side face of the package. It is preferable but not necessary that the upper frame portion 11 and the lower frame portion 12 contact only the sidewall or front walls of the each individual package unit 15 thereby leaving the package top surface 16 and likewise the opposite package bottom surface 25 freely available and accessible. Likewise, the band which comprise the upper frame portion 11 and the lower frame portion 12 and which extends around the periphery of the combined package unit 10 only encroaches into the front panel of the individual package units 15 a minimal amount so that a majority of the front panel is readily available for attachment of additional material if desired. It is also preferred that the upper frame 11 and lower frame portion 12 be transparent so that the entire individual package 15, a plurality of which forms the combined package unit 10, is easily visable to the consumer.

Preferably, both the upper frame portion 11 and the lower frame portion 12 of the transparent frame carton enclosure of the present invention be made of acrylic or plastic construction, a width of approximately ¼" to ½" and thickness of approximately 1/20th of an inch. The acrylic frame construction, if used is a sturdy and somewhat rigid retaining the package unit 10 together. The rigidity of the acrylic construction may aid in the stability or the enclosure and also aids in the stability of the interconnection mechanism, the locking beads and grooves to be described herein. Other similar type product construction for both the upper frame portion 11 and lower frame portion 12 are available and are considered to fall within the teachings of the present disclosure.

The combined package unit 10 of the present invention as depicted in FIG. 1 has ten individual package units adhered together. Both the first row 23 and second row 22 may be individually packaged and then combined with the upper frame portion and lower frame portion. These combination of rows is depicted in FIG. 2 wherein five of the packages are initially adhered together utilizing a two-sided adhesive 13. Application of a two-sided adhesive 13 to a row of five cigarette packs may be done with common packaging machinery. After a first and a second row 23 and 22 are adhered together to form the combined package unit 10, both the upper frame portion 11 and the lower frame portion 12 may be applied surrounding the periphery of the top and bottom of the combined package unit 10. While the adhesive 13 adhered the ten individual packages together, both the upper frame portion 11 and lower frame portion 12 are utilized to securely affix the entire package into a single unit and thereby retain all of the individual packages 15 within the combined package unit 10. Likewise an adhesive may be placed on the interior surface of the upper and lower frame portions 11 and 12 to further increase the stability of the unit.

Figure 3:
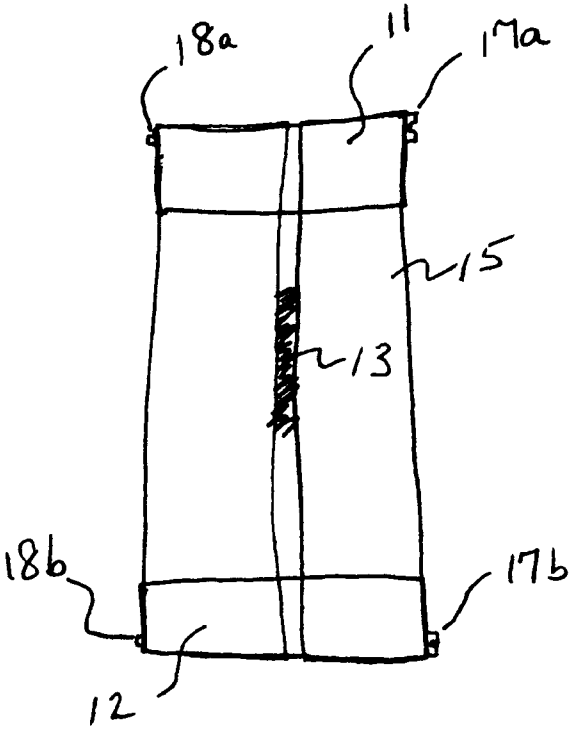
FIG. 3 is an end view of the transparent frame carton enclosure of FIG. 1.

Turning to FIG. 3, a side or end view of the combined package unit 10 is depicted wherein the upper frame portion 11 and lower frame portion 12 are clearly visible. In addition, the adhesive 13 is indicated on the back wall of both the individual package units depicted therein. Further, on one surface of the upper frame portion 11 is a locking bead 18*a* which extends outwardly from the upper portion of the upper frame 11. Similarly, on the opposing side of the upper frame 11 is found a locking groove 17*a*. Similar locking bead and locking grooves are found on the lower frame portion 12 and correspond to 18*b* and 17*b* therein. The locking beads 18*a* and 18*b* are designed to releasably engage the locking grooves 17*a* and 17 *b* found on the opposite sides of the combined package unit 10 and in fact, on both the upper frame portion 11 and lower frame portion 12. It is apparent that various constructions and placements of an interconnection element are readily available and are considered to fall within the teaching herein.

The locking bead 18*a* and locking groove 17*a* may be utilized so that during shipment or for placement of the combined package units 10 on a product display shelf, adjacent package units may be securely affixed together to form a unique display such that all of the units are securely held together. The design is such that each of the individual combined package units 10 may be readily removed from the combined stack of a plurality of combined package units given that the locking beads and locking grooves are made of acrylic or plastic-like material and readily engage and disengage one another.

Figure 4:
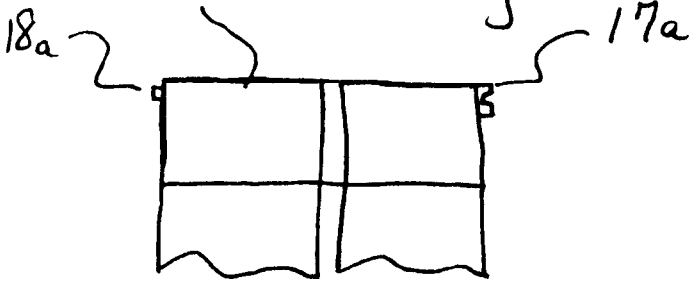
FIG. 4 is a close-up of the top portion of the transparent frame carton enclosure of the present invention shown in FIG. 1.
Figure 5:
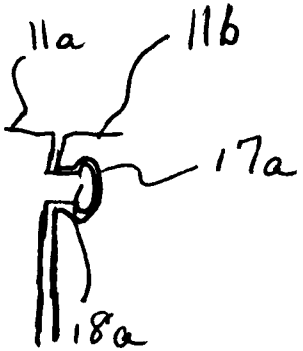
FIG. 5 is a sectional view of the transparent frame carton enclosure and closure of the present invention.

A close-up of the locking bead and locking grooves in the side view of FIG. 3 is depicted in FIG. 4 wherein the locking bead 18*a* and the locking groove 17*a* is likewise found. Shown in FIG. 5 is an extreme close-up of adjacent upper frame portions 11*a* and 11*b* wherein a locking bead 18*a* is releasably engaged into a locking groove 17*a* of an adjacent package. Such releasable engagement of the first upper frame 11*a* and the second package upper frame 11*b* allows the combined package units to be releasably attached to one another and thereby stacked in secured formation. It is commonly desired in the industry to stack a plurality of the package cartons together. However, due to the fact that the plurality of stacked carton are not secure, such stacking is not frequently done in a display environment. However, given the adjacent interconnection mechanism of the first package upper frame 11*a* and second package upper frame 11*b* and is understood (and a similar releasable locking engagement with the lower frame portion), a plurality of the combined package units 10 may be securely affixed together without worry as to the stability or instability of the stacked package units.

An alternative embodiment of the frame portion 11*c* shown in FIG. 6 is depicted. As is apparent, the frame portions 11 shown in FIG. 3, in 11*a* and 11*b* shown in FIG. 5 allow the connecting of combined packaging units in horizontal relationship due to the beads 18*a* and locking groove 17*a* extending outward on a horizontal plane. If it is desirable to stack the combined package units in a vertical nature, the embodiment shown in FIG. 6 is available wherein an upwardly locking bead 18*c* is depicted along one edge of the frame member 11*c*. On the opposing side of the frame member 11*c* is an upwardly extending locking groove 17*c*. As is apparent, there will be an appropriate lower frame member, not shown, which has a downwardly extending locking bead a downwardly extending locking groove, in opposite relationship as is depicted in FIG. 6, which will mate with the bead and groove 18*c* and 17*c* depicted in FIG. 6. Thus, the combined package units may be stacked one upon each other and the locking bead and grooves interconnect so that the combined package units are securely affixed to one another. As is evident and shown in FIG. 6*a,* combinations of horizontal and vertical locking grooves and locking beads may be utilized to provide the necessary effect of stacking in either the horizontal, vertical, or combination directions. Again, similar interconnection mechanisms for releasable attachment will be formed on the lower frame portion which is not shown in these figures. Similarly, as opposed to the locking bead and locking groove construction depicted, locking channels or recesses may be utilized on the frame members for interconnection therein.

The foregoing detailed description is given primarily for clearness of understanding and no unnecessary limitations are to be understood therefrom for modification can be made by those skilled in the art upon reading the disclosure and may be made without departing from the spirit of the invention and scope of the appended claims.

What is claimed is:

1. A transparent frame carton enclosures, comprising:

a plurality of individual packages;

an upper frame portion extending along an upper periphery of said plurality of packages;

a lower frame portion extending along an lower periphery of said plurality of packages;

wherein said upper frame portion and said lower frame portion have an interconnection nechanism for releasable attachment;

and further wherein said interconnection mechanism of said upper frame portion and said lower frame portion is comprised of a locking bead extending outwardly from a first side of said upper frame portion and said lower fame portion and a locking groove extending outwardly from a second side of said upper frame portion and said lower frame portion.

2. The transparent frame carton enclosure of claim 1 wherein said locking groove has a first wall and a second wall and a groove therebetween, said groove spaced to releasably engage said locking bead.

3. A transparent frame carton enclosure, comprising:

a plurality of individual packages;

an upper frame portion extending along an upper periphery of said plurality of packages;

a lower frame portion extending along an lower periphery of said plurality of packages;

wherein said upper frame portion and said lower frame portion have an interconnection mechanism for releasable attachment;

and wherein said first row and said second row of packages each are comprised of five packages in side-by-side relationship.

4. The transparent frame carton enclosure of claim 3 wherein said first row and said second row of individual packages are in back-to-back relationship.

5. The transparent frame carton enclosure of claim 4 further comprising a strip of adhesive which retains said packages in side-by-side relationship.

6. The transparent frame carton enclosure of claim 5 where said strip of adhesive is a two-sided strip of adhesive which retains said first row and said second row in adjacent relationship.

7. A transparent frame carton enclosure, comprising:

a plurality of individual packages;

an upper frame portion extending along an upper periphery of said plurality of packages;

a lower frame portion extending along an lower periphery of said plurality of packages;

wherein said upper frame portion and said lower frame portion have an interconnection mechanism for releasable attachment;

wherein said upper frame portion and said lower frame portion extend along the periphery of said plurality of packages have an adhesive on an inner side thereof contacting said plurality of packages.

8. The transparent frame carton enclosure of claim 7 wherein said upper frame portion and said lower frame portion contact a side surface of each of said plurality of said packages and further wherein said plurality of packages has a top surface and opposing bottom surface, said upper frame portion and said lower frame portion not extending onto said top surface and said bottom surface.

9. A combined package unit, comprising:

a first row of a plurality of packages and a second row of a plurality of packages, wherein said first row and said second row are in back to back relationship;

said first row and said second row of packages having top surface, bottom surface and side wall surfaces;

an upper transparent frame portion extending around an upper portion of said side wall surface of said first row and said second row of packages;

a lower transparent frame portion extending around a lower portion of a side wall surface of said first row and said second row of packages;

wherein said top surface and said bottom surface of said first row and said second row of packages is not covered by said upper transparent frame portion and said lower transparent frame portion.

10. The combined package unit of claim 9 further comprising an interconnecting mechanism formed on said upper transparent frame portion and said lower transparent frame portion.

11. The combined package unit of claim 9 further comprising a locking bead and a locking groove extending outwardly from said upper frame portion and said lower frame portion.

12. The combined package unit of claim 11 wherein said locking bead extends outward from said upper frame portion and said lower frame portion on a first side and said locking groove extends outward from said upper frame portion and said lower frame portion on a second opposite side.

* * * * *